United States Patent [19]

Skinner

[11] 4,355,609

[45] Oct. 26, 1982

[54] LIQUID FUEL PUMPING APPARATUS

[75] Inventor: Robert T. J. Skinner, High Wycombe, England

[73] Assignee: Lucas Industries Limited, Birmingham, England

[21] Appl. No.: 148,680

[22] Filed: May 12, 1980

[30] Foreign Application Priority Data

Jun. 26, 1979 [GB] United Kingdom ..... 7922172

[51] Int. Cl.[3] ..... F02M 59/42; F02D 1/09

[52] U.S. Cl. ..... 123/373; 123/368

[58] Field of Search ..... 123/373, 368, 366, 365

[56] References Cited

U.S. PATENT DOCUMENTS 4,176,642 12/1979 Shipinski ..... 123/373

4,239,025 12/1980 Konrath ..... 123/366

*Primary Examiner*—Ira S. Lazarus

*Assistant Examiner*—Carl Stuart Miller

[57] ABSTRACT

A liquid fuel pumping apparatus comprises a fuel pump having an axially movable quantity control member connected to one end of a first lever which is pivoted about a fixed axis. An engine speed responsive device acts on the lever and a second lever is provided and pivoted about the said axis. A governor spring acts upon the second lever in the opposite direction to the force exerted on the first lever by the speed responsive device. Means is provided which acts to cause separation of the levers with a force which decreases as the levers move towards each other and a stop is provided to limit the movement of the second lever under the action of the governor spring. The aforesaid means is operative when the engine is at rest to cause separation of the levers to move the control member to a position at which the pump will supply an excess of fuel for starting purposes.

6 Claims, 2 Drawing Figures

LIQUID FUEL PUMPING APPARATUS

This invention relates to a liquid fuel pumping apparatus for supplying fuel to an internal combustion engine and of the kind including a fuel pump having a quantity control member movable in one direction to increase the amount of fuel supplied by the pump and in the other direction to reduce the amount of fuel supplied by the pump, first means responsive to the speed of operation of the pump for effecting movement of the member in said other direction, a governor spring acting in opposition to said means, manually operable means for varying the force exerted by the governor spring and a stop acting to limit the maximum amount of fuel which can be supplied by the pump in use.

With such an apparatus it is necessary to provide for an amount of fuel in excess of the normal maximum, to be delivered to the engine for starting purposes. In many cases this excess supply of fuel should continue until after starting, the engine has accelerated to a predetermined speed above its normal idling speed. Thereafter the excess supply must cease even when the engine speed drops to its idling speed, in order to avoid emission of smoke in the engine exhaust.

Various proposals have been made to achieve the supply of the excess fuel and to fulfill the requirements set out. In general the known arrangements are of a mechanical nature employing movable stops or of a hydromechanical nature. The known systems must be carefully constructed in order to ensure that they function in a reliable manner.

The object of the present invention is to provide an apparatus of the kind specified in a simple and convenient form.

According to the invention an apparatus of the kind specified comprises a pair of levers pivotally mounted about a common axis and movable relative to each other, one of said levers being connected to said control member and to said means responsive to the pump speed, the other lever being connected to said governor spring, said stop being positioned to be contacted by said other lever to limit the movement of the other lever under the action of said governor spring, and second means acting intermediate said levers, said second means producing a force acting to separate said levers, the force exerted by said second means reducing as the levers move towards each other under the action of said first means, the arrangement being such that when the apparatus is at rest the levers will be moved away from said fixed relative position by the second means so that said one lever can move the control member to a position in which the excess of fuel is supplied and as the engine speed increases following starting of the engine, the levers will be moved towards each other, to said fixed relative position and will be retained in said position by the action of the first means even when the engine speed subsquently falls to its idling value, said second means separating said levers only in the event that the engine is stopped.

Two examples of fuel pumping apparatus in accordance with the invention will now be described with reference to the accompanying diagrammatic drawings.

Figure 1:
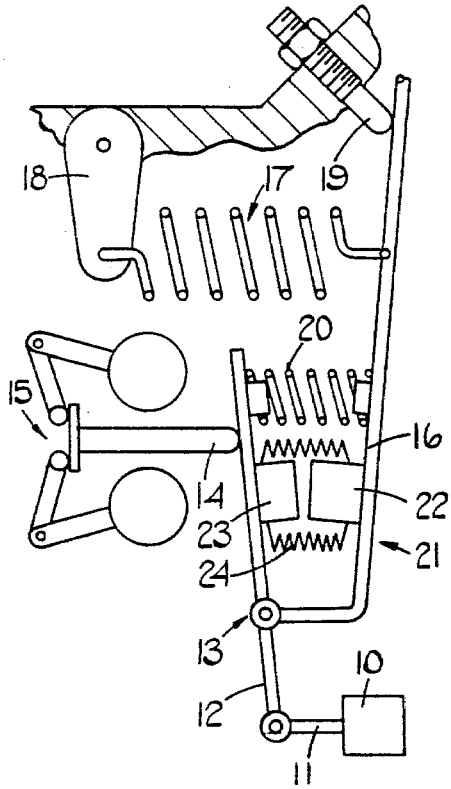
FIG. 1 shows a first embodiment of the invention in which the pivoted links are biased by a magnet member and a ferrous element.

Referring to FIG. 1 of the drawings an example of a fuel pump is indicated at 10 the pump being for example, of the "in-line type" that is to say it comprises a number of individual injection pumps which are operated by cams respectively mounted on a shaft which is driven by an associated engine. The individual injection pumps are connected to a fuel quantity control member which is indicated at 11 and which is axially movable to vary the quantity of fuel supplied by the pumps during the injection strokes thereof.

The quantity control member 11 is pivotally connected to one end of a lever 12 which is pivotally mounted at 13. The other end of the lever is engaged by the output member 14 of a speed responsive mechanism generally indicated at 15 and comprising a plurality of governor weights mounted within a cage not shown. The cage conveniently is mounted upon the drive shaft of the pump and in operation, as the shaft rotates the weights will move outwardly and impart axial movement to the output member 14. This axial movement will through the lever 12, result in axial movement of the control member 11 in a direction to reduce the quantity of fuel delivered by the injection pumps.

A second lever 16 is provided and it is pivotally mounted about the same pivot axis as the lever 12 conveniently the lever 16 is cranked. The lever 16 is connected to one end of a governor spring 17 the other end of which is connected to a manually operable lever 18. Moreover, a stop 19 is provided which is engageable with the lever 16 to limit the extent of movement of the lever 16 under the action of the spring 17.

Acting between the levers is a resilient means in the form of a coiled compression spring 20 and furthermore, located between the levers is a magnetic means 21 which comprises a magnet 22 secured to one of the levers and a ferrous member 23 secured to the other lever. Conveniently the magnet 22 and ferrous member 23 are enclosed within a rubber or like bellows 24 which may be filled with a liquid. The purpose of the bellows is to prevent ferrous particles collecting on the magnet and ferrous member.

The setting of the various parts shown in the drawing is the setting assumed when the engine is at rest. It will be noted that the spring 20 has moved the levers 12 and 16 relative to each other with the result that although the lever 16 is in contact with the stop 19, additional movement has been imparted to the quantity control member 11 such that an excess of fuel will be obtained upon starting of the engine. In the rest position the governor weights are moved inwardly their maximum extent. When the engine starts the weights will begin to move upwardly and the practical effect is that the spring 20 will be compressed. No movement will be imparted to the lever 16 because of the force exerted by the governor spring however as compression of the spring 20 takes place the lever 12 will move in the clockwise direction and will effect a reduction in the amount of fuel supplied to the engine. As movement of the lever 12 takes place the gap between the magnet 22 and the ferrous member 23 will decrease and therefore the attraction force between these two components will increase. At the same time however as the spring 20 is compressed there will be a slight increase in the force which it exerts. The net force separating the two levers will tend to decrease as the levers move towards each other.

As the engine speed continues to rise a point will be reached at which the force exerted by the spring 20 is overcome by the force exerted by the governor weights and also by the attraction force developed between the magnet 22 and the ferrous member 23. The two levers will then be held in a fixed relative position and will thereafter move as a single lever. The practical effect is that the stop 19 now determines the maximum amount of fuel which can be supplied to the engine and the normal governing action will take place. As therefore the engine speed increases for a given force exerted by the governor spring 17, the weights will gradually move outwardly to effect a reduction in the amount of fuel supplied to the engine thereby governing the speed of the engine. If the force exerted by the governor spring is reduced as by movement of the lever 18, then the engine speed will gradually fall. If the lever 18 is moved to the idling position, the engine speed will assume its idling value but even at idling speed, a force will be generated by the governor weights which in conjunction with the attraction between the magnet 22 and the ferrous member is sufficient to maintain the spring 20 in its compressed state. If however the engine is stopped then the force exerted by the weights disappears and it is arranged that the force exerted by the spring 20 is higher than that which can be exerted by the magnet 22 with the result that the two levers move relative to each other under the action of the spring 20 to the position shown in the drawing.

The practical effect is that an excess of fuel is obtained for starting purposes and the excess of fuel is maintained as the engine accelerates to above its normal idling speed. At some predetermined speed above the idling speed the levers are locked together by the action of the attraction force of the magnet and the ferrous member and thereafter so long as the engine is kept running the levers are locked together even when the speed of the engine falls to its idling speed. When the engine stops however the force exerted by the spring 20 overcomes the attraction force between the magnet and the ferrous member and the levers move to the position shown in the drawing in which an excess of fuel will be supplied when the engine is started.

It will be appreciated that the spring 20 together with the magnet 22 and the ferrous member 23 form a combination the force exerted by which in the direction to oppose movement of the levers 12, 16 towards each other decreases the closer the levers are to each other. A similar effect can be obtained by using a spring and such a construction is shown in FIG. 2.

Figure 2:
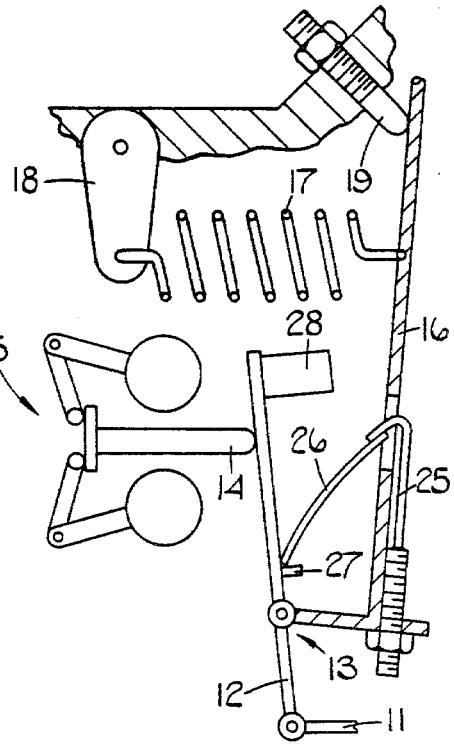
FIG. 2 shows a second embodiment of the invention in which the pivoted links are biased by a leaf spring.

In FIG. 2 the parts which have the same function have the same reference numerals as the parts in FIG. 1.

As will be seen lever 16 mounts a leaf spring support 25. This extends along the side of the lever 16 and is adjustably mounted thereon. The support has a hook line end portion which extends through a slot in the lever and mounted on the end portion is a leaf spring 26. The spring 26 extends rearwardly towards the pivot 13 but engages the lever 12 at a position removed from the pivot. As shown the free end of the spring engages a projection 27 mounted on the lever but the free end of the spring could be curied for sliding engagement with the lever 16. In the former case when the engine is started the force exerted by the spring 26 opposes the force exerted by the mechanism 15 and the levers will remain in the relative position shown until the force exerted by the mechanism exceeds the force exerted by the spring. As the levers move towards each other the curvature of the spring 26 will increase but the line of action will move closer to the pivot 13 so that the actual force exerted between the levers reduces as the levers move closer. A stop 28 is provided to prevent the line of action passing through the pivot axis. In the second case the spring 26 will be stressed as the levers move towards each other but its point of contact with the lever 12 will move closer to the pivot so that the force exerted between the levers decreases.

The leaf spring in the arrangement shown in FIG. 2 can be replaced by a coiled compression spring which is located about a guide rod carried by one of the levers and passing through an aperture in the other. The guide rod acts to prevent bending of the spring along its length so that as the levers move towards each other the spring will be compressed.

I claim:

1. A liquid fuel pumping apparatus for supplying fuel to an internal combustion engine and of the kind comprising a fuel pump having a quantity control member movable in one direction to increase the amount of fuel supplied by the pump and in the other direction to reduce the amount of fuel supplied by the pump, first means responsive to the speed of operation of the pump for effecting movement of the member in said other direction, a governor spring acting in opposition to said means, manually operable means for varying the force exerted by the governor spring, a pair of levers pivotally mounted about a common axis and movable relative to each other, one of said levers being connected to said control member and to said means responsive to the pump speed, the other lever being connected to said governor spring, a stop positioned to be contacted by said other lever to limit the movement of the other lever under the action of said governor spring, and second means operatively connected to said levers, said second means producing a force acting to effect relative movement of said levers, the force exerted by said second means reducing as the levers move relative to each other under the action of said first means, the arrangement being such that when the apparatus is at rest, the levers will be moved away from a fixed relative position by the second means so that said one lever can move the control member to a position in which an excess of fuel is supplied and as the engine speed increases following starting of the engine, the levers will be moved relative to each other, to said fixed relative position and will be retained in said position by the action of the first means even when the engine speed subsequently falls to its idling value, said second means causing relative movement of said levers only in the event that the engine is stopped.

2. An apparatus according to claim 1 in which said second means comprises a compression spring positioned between said levers to effect separation thereof and a magnet carried by one of the levers and a ferrous member carried on the other of said levers at a position to be attracted by said magnet, the net force created by said second means and acting to separate the levers decreasing as the levers move towards each other.

3. An apparatus according to claim 1 in which said second means comprises a resilient member mounted on one of said levers at a first position removed from said axis, said resilient member extending into engagement with the other lever at a second position nearer to said axis than said first position.

4. An apparatus according to claim 3 in which said second position is a fixed position defined by a projection on said other lever, the apparatus including a stop carried by one of the levers engageable by the other lever and which acts to prevent the line of action of the resilient member passing through said axis.

5. An apparatus according to claim 3 or claim 4 in which said resilient member comprises a leaf spring.

6. An apparatus according to claim 3 in which said second position is a variable position and moves towards said axis as the levers move towards each other and in which said resilient member is a leaf spring.

* * * * *